US007165330B2

(12) United States Patent
Yeh

(10) Patent No.: US 7,165,330 B2
(45) **Date of Patent: *Jan. 23, 2007**

(54) PIVOTAL DEVICE FOR SCISSORS

(76) Inventor: Wen-Ya Yeh, Suite 2, 15th Floor, No. 18, Chuney-Hsueh Rd., Tainan (TW)

( * ) Notice: Subject to any disclaimer, the term of this patent is extended or adjusted under 35 U.S.C. 154(b) by 22 days.

This patent is subject to a terminal disclaimer.

(21) Appl. No.: 11/119,643

(22) Filed: May 2, 2005

(65) Prior Publication Data

US 2005/0188543 A1 Sep. 1, 2005

Related U.S. Application Data

(63) Continuation-in-part of application No. 10/784,621, filed on Feb. 23, 2004, now Pat. No. 6,904,685.

(51) Int. Cl.
*B26B 13/28* (2006.01)

(52) U.S. Cl. ..... 30/266; 30/254; 30/341

(58) Field of Classification Search ..... 30/254, 30/266, 267, 270, 340, 341, 342
See application file for complete search history.

(56) References Cited

U.S. PATENT DOCUMENTS

| | | | | |
|---|---|---|---|---|
| 927,058 | A | 7/1909 | Krouse | 30/341 |
| 967,436 | A | 8/1910 | Ramsey | 30/267 |
| 1,555,286 | A | 9/1925 | Rutherford | 30/270 |
| 1,633,441 | A | 6/1927 | Firth | 30/267 |
| 2,395,897 | A | 3/1946 | Ketheart | 30/230 |
| 3,170,237 | A | 2/1965 | Curt | 30/268 |
| 3,672,053 | A | 6/1972 | Wiss | 30/267 |
| 5,517,761 | A | 5/1996 | Wang | 30/254 |
| 6,367,155 | B2 | 4/2002 | Homann | 30/140 |
| 6,904,685 | B1 * | 6/2005 | Yeh | 30/254 |

* cited by examiner

*Primary Examiner*—Hwei-Siu Payer
(74) *Attorney, Agent, or Firm*—Alan D. Kamrath; Nikolai & Mersereau, P.A.

(57) ABSTRACT

A pair of scissors includes two scissor elements and a pivotal device. Each scissor element includes a countersink extending from a first side thereof through a second side thereof. The pivotal device includes a screw and a nut. The screw includes a threaded shank and an enlarged head. The nut includes a non-circular shank and an enlarged head, with a screw hole extending through the non-circular shank and the enlarged head of the nut. The nut is received in the countersink of one of the scissor elements, with the non-circular shank of the nut extending into a non-circular countersink of the other scissor element. The threaded shank of the screw is threadedly engaged with the screw hole of the nut. Thus, the contact area between the screw and the pivotable scissor elements is small.

3 Claims, 10 Drawing Sheets

PIVOTAL DEVICE FOR SCISSORS

CROSS REFERENCE TO RELATED APPLICATION

This is a continuation-in-part application of U.S. patent application Ser. No. 10/784,621 filed Feb. 23, 2004, now U.S. Pat. No. 6,904,685.

BACKGROUND OF THE INVENTION

1. Field of the Invention

The present invention relates to a pivotal device for a pair of scissors.

2. Description of the Related Art

FIGS. 9 and 10 of the drawings illustrate a pair of conventional scissors including a scissor element 1 and a second scissor element 2. The first scissor element 1 and the second scissor element 2 are pivotally connected by a pivotal device consisting of a bolt or screw 4 and a nut 6. As illustrated in FIG. 10, the first scissor element 1 includes a through-hole 7 extending from a side of the first scissor element 1 through the other side of the first scissor element 1. Further, the second scissor element 2 includes a countersink 8 extending from a side of the second scissor element 2 through the other side of the second scissor element 2. The countersink 8 includes a smaller section 8*b* aligned with the through-hole 7 of the first scissor element 1 and a larger section 8*a*.

The screw 4 has a threaded shank 5 extending through the smaller section 8*b* of the countersink 8 and the through-hole 7 of the first scissor element 1 and then engaged with a screw hole 3 of the nut 6, with an enlarged head 4*a* of the screw 4 being fittingly received in the larger section 8*a* of the countersink 8.

Nevertheless, the pivotal arrangement is apt to be loosened, as the screw 4 directly contacts with and thus might move together with the first scissor element 1 and the second scissor element 2 that pivot relative to each other during use of the pair of scissors. Further, the exposed nut 6 may interfere with operation of the pair of scissors.

SUMMARY OF THE INVENTION

In accordance with an aspect of the invention, a pair of scissors in accordance with the present invention includes a first scissor element, a second scissor element, and a pivotal device for pivotally engaging the first scissor element with the second scissor element. The first scissor element includes a countersink extending from a first side of the first scissor element through a second side of the first scissor element. The countersink of the first scissor element has a larger section facing away from the second scissor element and a non-circular smaller section facing the second scissor element.

The second scissor element includes a countersink extending from a first side of the second scissor element through a second side of the second scissor element. The countersink of the second scissor element has a larger section facing away from the first scissor element and a smaller section facing the first scissor element and aligned with the smaller section of the countersink of the first scissor element.

The pivotal device includes a screw and a nut. The screw includes a threaded shank and an enlarged head. The nut includes a non-circular shank and an enlarged head, with a screw hole extending through the non-circular shank and the enlarged head of the nut.

The nut is received in the countersink of the first scissor element, with the enlarged head of the nut being received in the larger section of the countersink of the first scissor element, and with the non-circular shank extending through the non-circular smaller section of the countersink of the first scissor element and the smaller section of the countersink of the second scissor element.

The threaded shank of the screw is threadedly engaged with the screw hole of the nut, with the enlarged head of the screw being received in the larger section of the countersink of the second scissor element.

Thus, the contact area between the screw and the pivotable scissor elements is small as compared to the conventional designs. Thus, the screw is less likely to move when the scissor elements pivot. The risk of loosening of the screw and/or the nut is reduced. A reliable pivotal arrangement is provided accordingly.

In an embodiment, the non-circular smaller section of the countersink of the first scissor element is substantially circular and comprises two parallel flat portions delimited by two parallel flat walls. Further, the non-circular shank of the nut is substantially circular and comprises two flat faces respectively in contact with the flat walls.

Alternatively, the non-circular smaller section of the countersink of the first scissor element may be square, rectangular, polygonal, or ellipsoid, and the non-circular shank of the nut may be square, rectangular, polygonal, or ellipsoid and in contact with a perimeter wall delimiting the non-circular smaller section of the countersink of the first scissor element.

Other objects, advantages, and novel features of the invention will become more apparent from the following detailed description when taken in conjunction with the accompanying drawings.

DETAILED DESCRIPTION OF THE PREFERRED EMBODIMENTS

Referring to FIGS. 1 through 5, a pair of scissors in accordance with the present invention comprises a first scissor element 11, a second scissor element 12, and a pivotal device for pivotally engaging the first scissor element 11 with the second scissor element 12.

Figure 1:
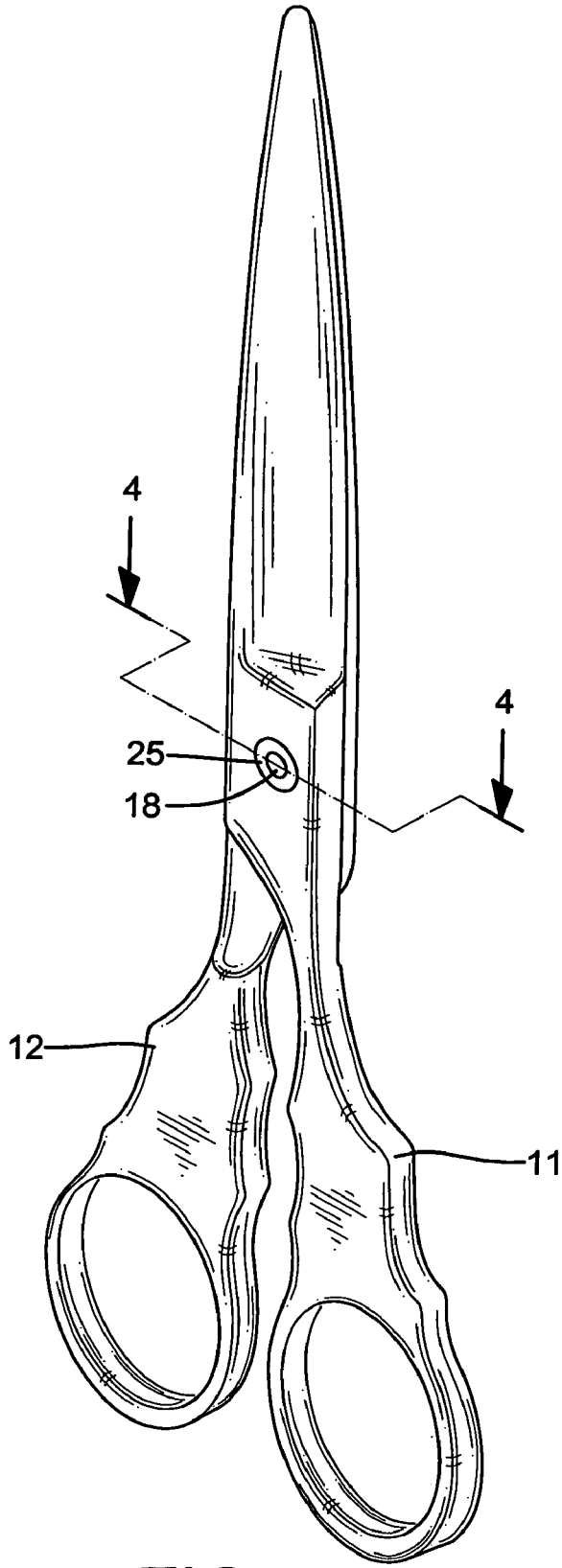
FIG. 1 is a perspective view of an embodiment of a pair of scissors in accordance with the present invention.
Figures 2, 2A:
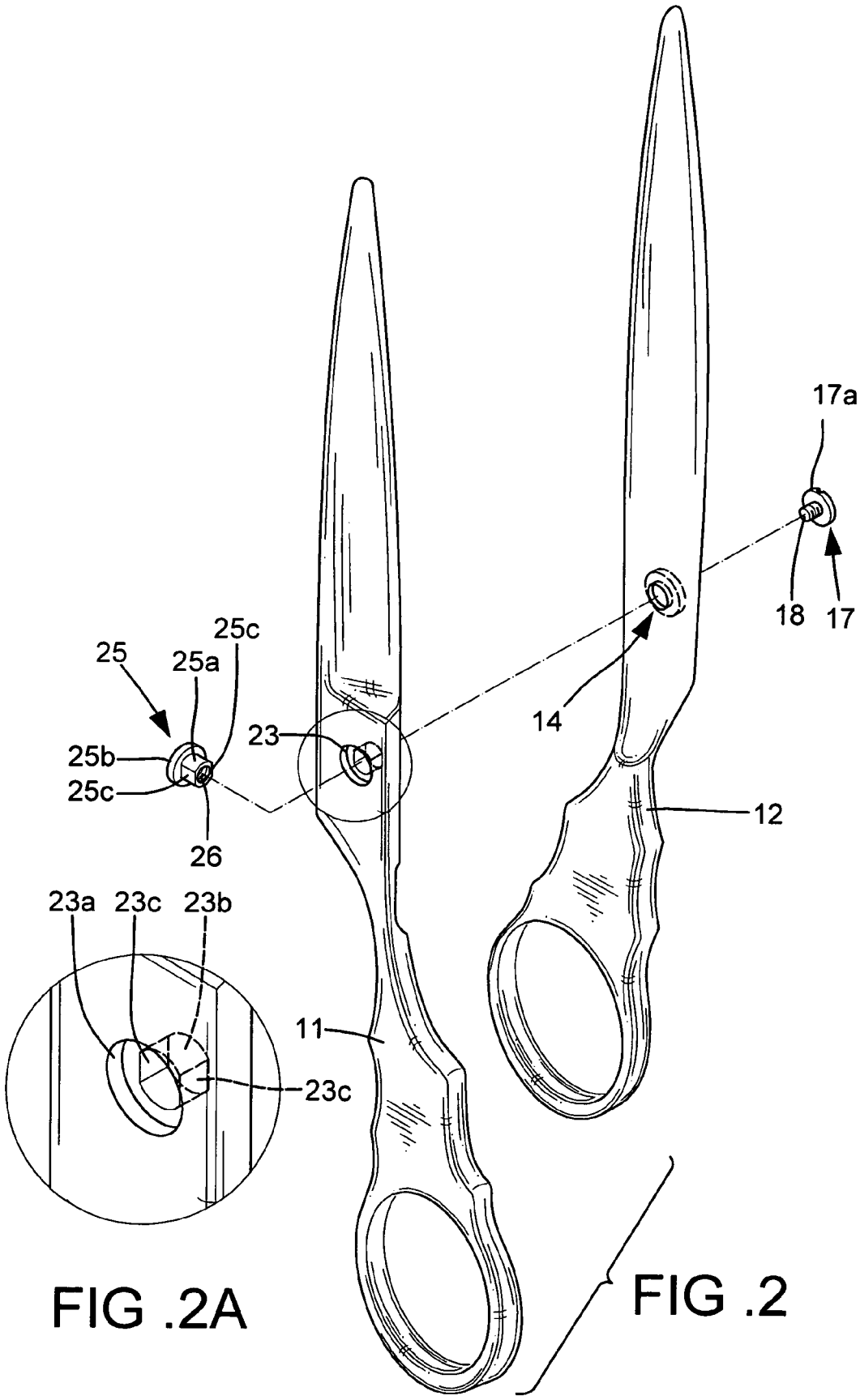
FIG. 2 is an exploded perspective view of the pair of scissors in accordance with the present invention.
FIG. 2A is an enlarged view of a circled portion in FIG. 2.
Figure 3:
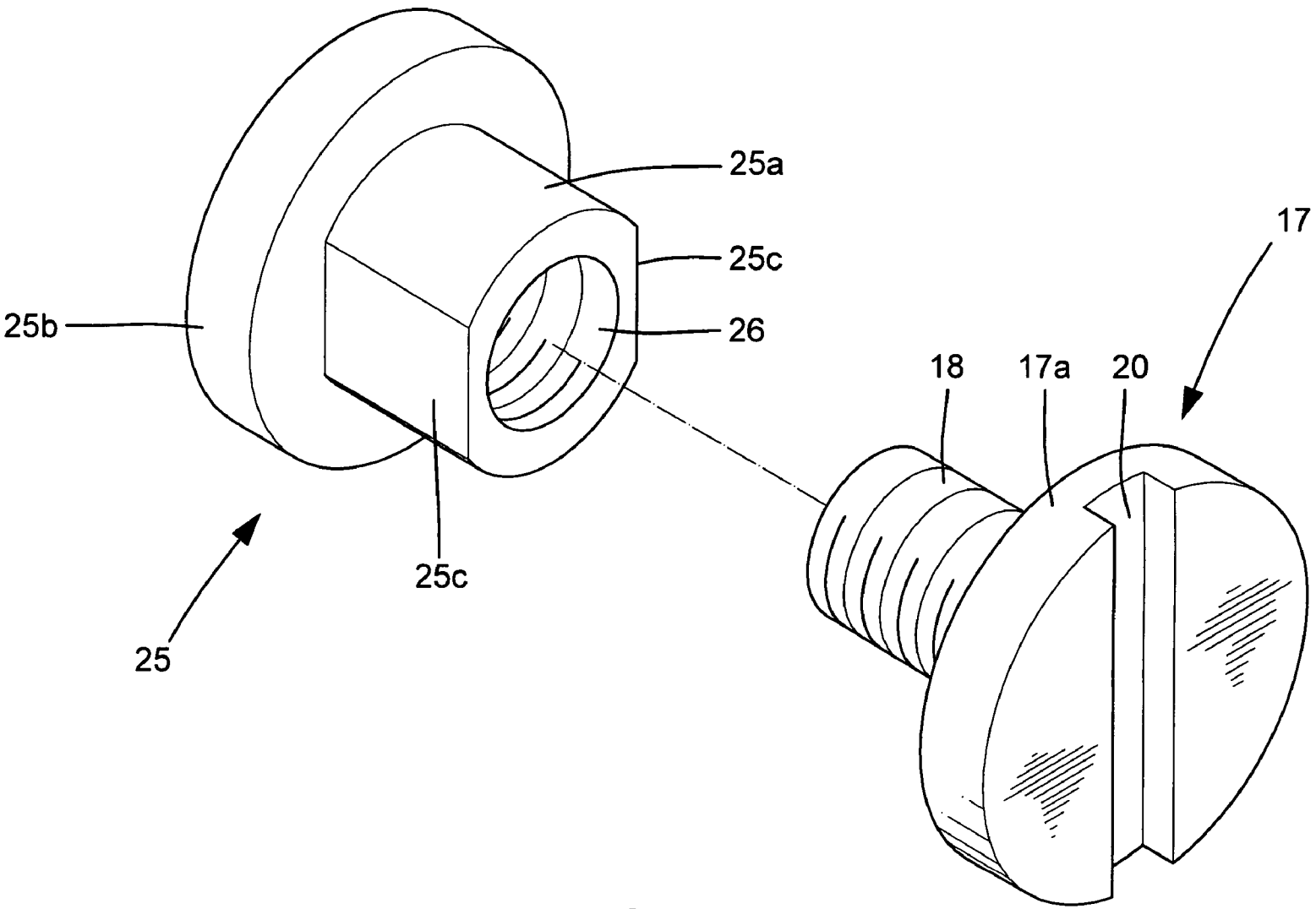
FIG. 3 is an enlarged exploded perspective view of a pivotal device of the pair of scissors in accordance with the present invention.
Figure 4:
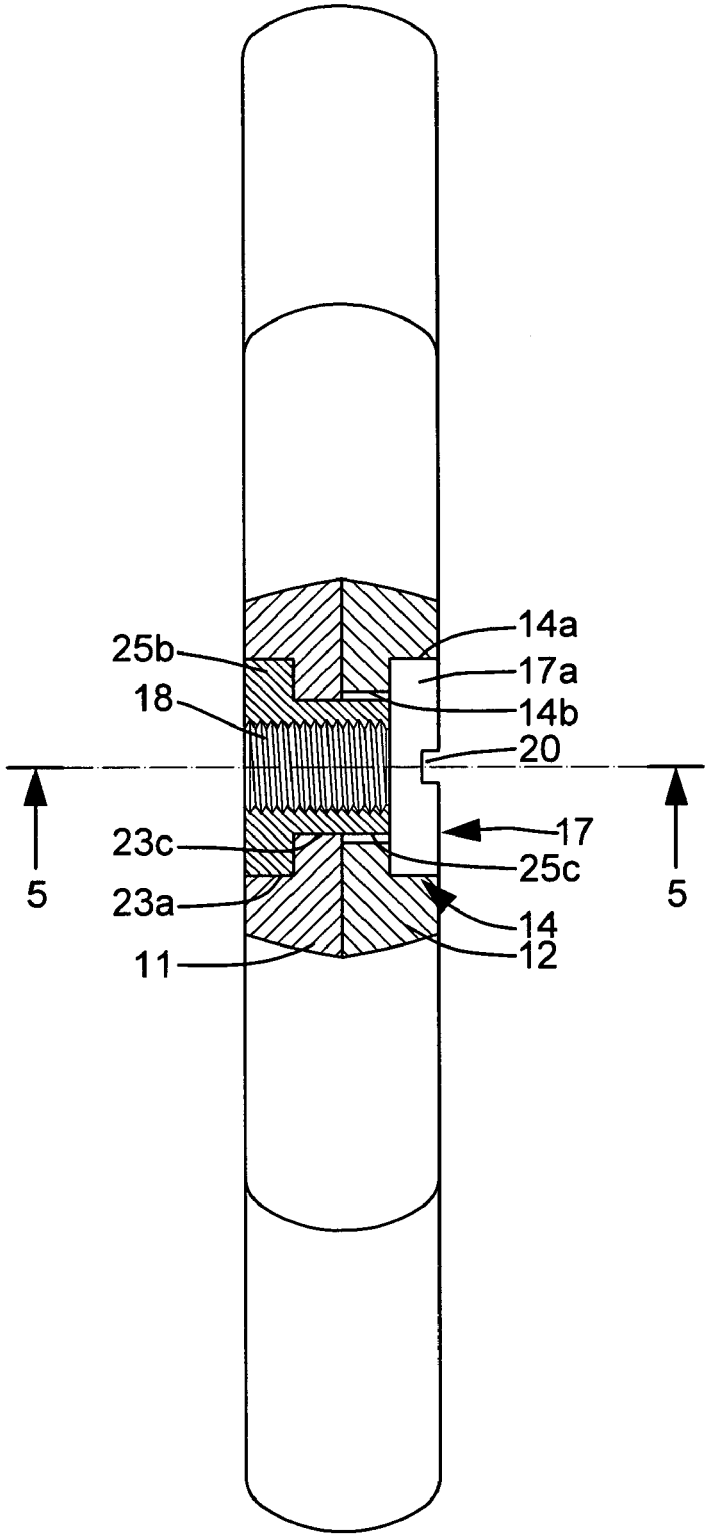
FIG. 4 is a sectional view taken along plane 4—4 in FIG. 1.

As illustrated in FIGS. 2, 2A, and 4, the first scissor element 11 includes a countersink 23 extending from a first side of the first scissor element 11 through a second side of the first scissor element 11. The countersink 23 of the first scissor element 11 has a larger section 23*a* facing away from the second scissor element 12 and a smaller section 23*b* facing the second scissor element 12. It is noted that the smaller section 23*b* is substantially circular and includes two flat portions 23*c* parallel to each other. In other words, the smaller section 23*b* is non-circular.

As illustrated in FIGS. 2 and 4, the second scissor element 12 includes a countersink 14 extending from a first side of the second scissor element 12 through a second side of the second scissor element 12. The countersink 14 of the second scissor element 12 has a larger section 14*a* facing away from the first scissor element 11 and a smaller section 14*b* facing the first scissor element 11 and aligned with the smaller section 23*b* of the countersink 23 of the first scissor element 11.

The pivotal device includes a bolt or screw 17 and a nut 25. The screw 17 includes a threaded shank 18 (having an outer threading) and an enlarged head 17*a*. The nut 25 includes a shank 25*a* and an enlarged head 25*b*, with a screw hole 26 extending through the shank 25*a* and the enlarged head 25*b*. Further, the shank 25*a* is substantially circular and includes two flat faces 25*c* parallel to each other. In other words, the smaller section 23*b* is non-circular.

Figure 5:
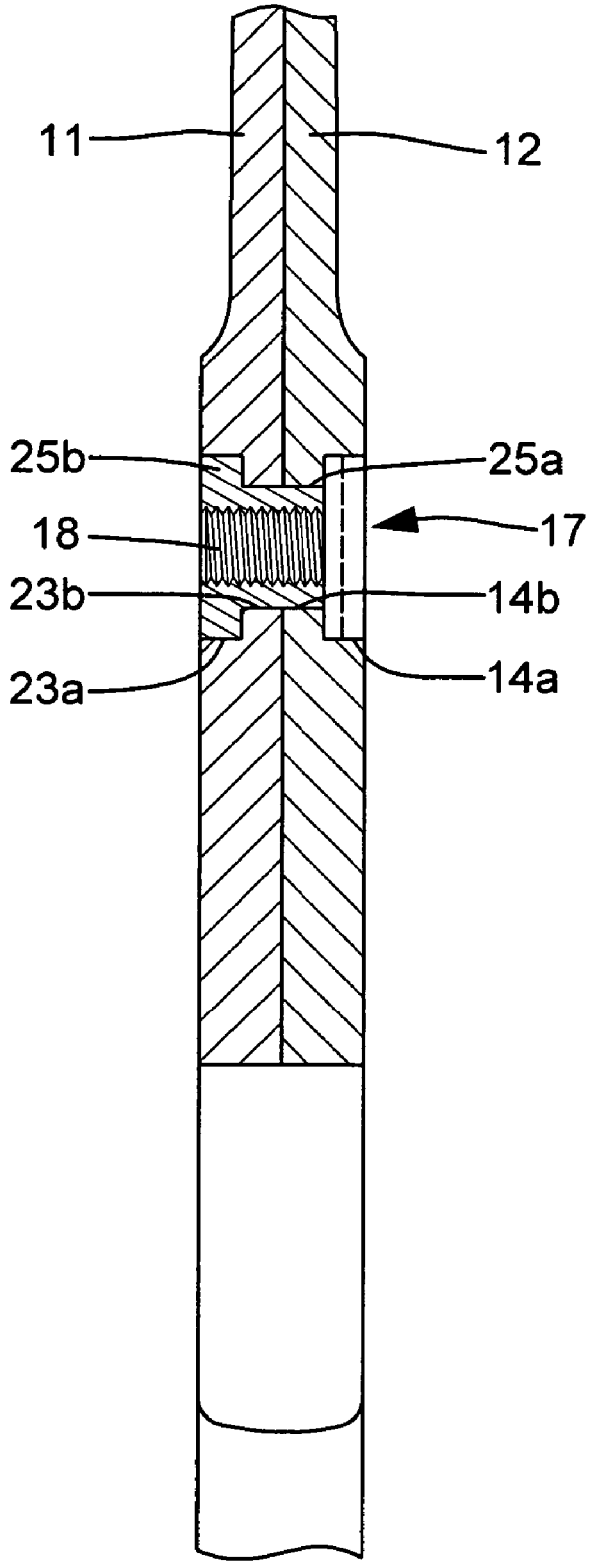
FIG. 5 is a sectional view taken along plane 5—5 in FIG. 4.

In assembly, as illustrated in FIGS. 4 and 5, the nut 25 is inserted into the countersink 23 of the first scissor element 11, with the enlarged head 25*b* being fittingly received in the larger section 23*a* of the countersink 23, and with the non-circular shank 25*a* extending through the non-circular smaller section 23*b* of the countersink 23 of the first scissor element 11 and the smaller section 14*b* of the countersink 14 of the second scissor element 12. It is noted that the flat faces 25*c* of the nut 25 are respectively in contact with two flat walls delimiting the flat portions 23*c* of the countersink 23. Next, the threaded shank 18 of the screw 17 is threadedly engaged with the screw hole 26 of the nut 25 until the enlarged head 17*a* of the screw 17 is fittingly received in the larger section 14*a* of the countersink 14 of the second scissor element 12. The enlarged head 17*a* of the screw 17 includes a slot 20, allowing the user to drive the screw 17 with a screwdriver or the like.

As can be seen from FIG. 4, the screw 17 is not in contact with the first scissor element 11, and the screw 17 is in contact with the second scissor element 12 at the enlarged head 17*a*. Thus, the contact area between the screw 17 and the pivotable scissor elements 11 and 12 is relatively small as compared to the conventional designs. Thus, the screw 17 is less likely to pivot when the scissor elements 11 and 12 pivot. The risk of loosening of the screw 17 and/or the nut 25 is reduced. A reliable pivotal arrangement is provided accordingly.

Figures 6, 6A:
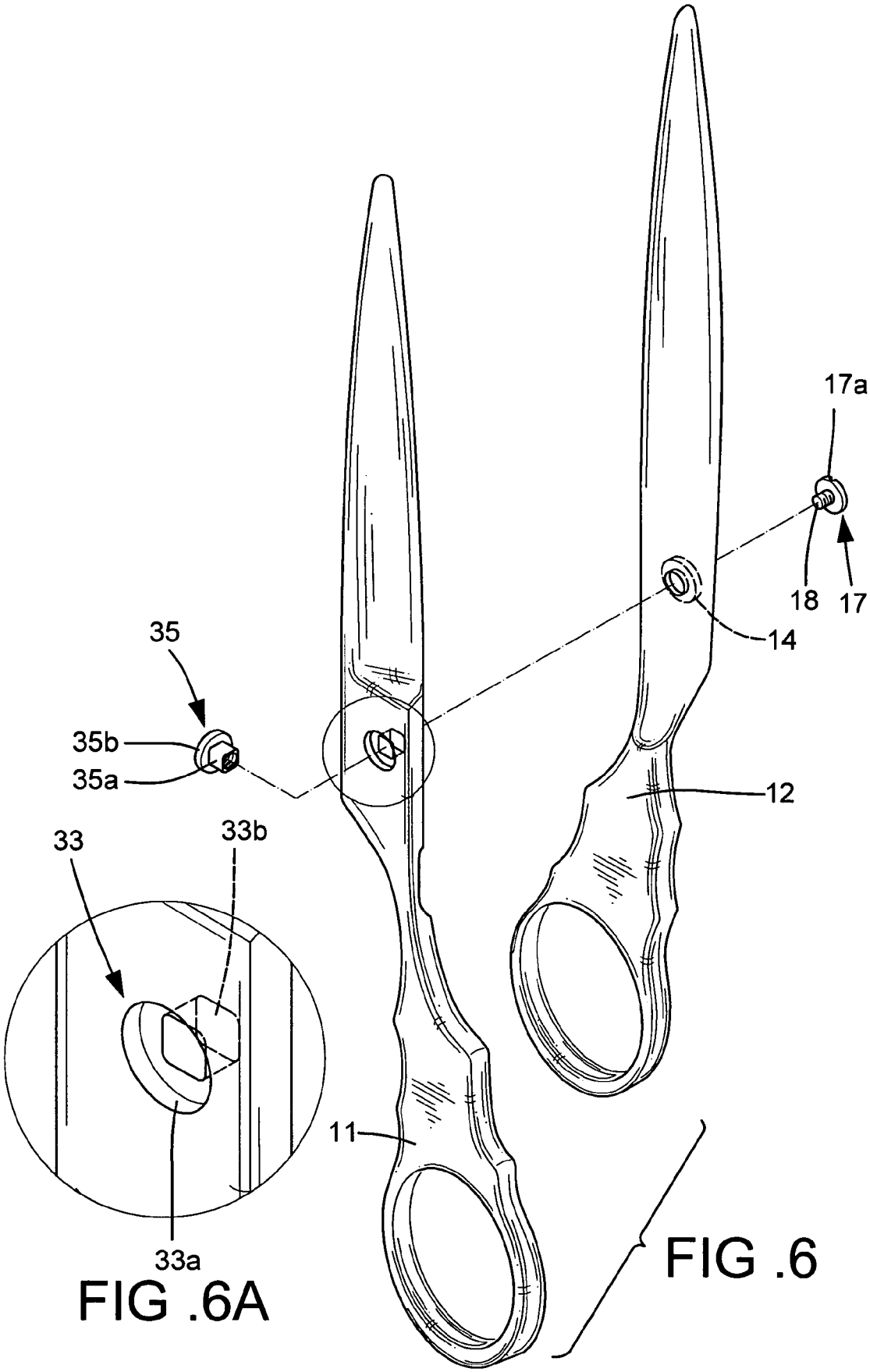
FIG. 6 is an exploded perspective view of a modified embodiment of the pair of scissors in accordance with the present invention.
FIG. 6A is an enlarged view of a circled portion in FIG. 6.

FIGS. 6 and 6A illustrate a modified embodiment of the invention, wherein the countersink (now designated by 33) of the first scissor element 11 has a larger section (now designated by 33*a*) facing away from the second scissor element 12 and a smaller section (now designated by 33*b*) facing the second scissor element 12. It is noted that the smaller section 33*b* is substantially square or rectangular. Further, the nut (now designated by 35) includes an enlarged head (now designated by 35*b*) and a substantially square or rectangular shank (now designated by 35*a*) having four sides (not labeled) that are respectively in contact with the four sidewalls delimiting the smaller section 33*b* of the countersink 33. This arrangement also provides a reliable pivotal device.

Figures 7, 7A:
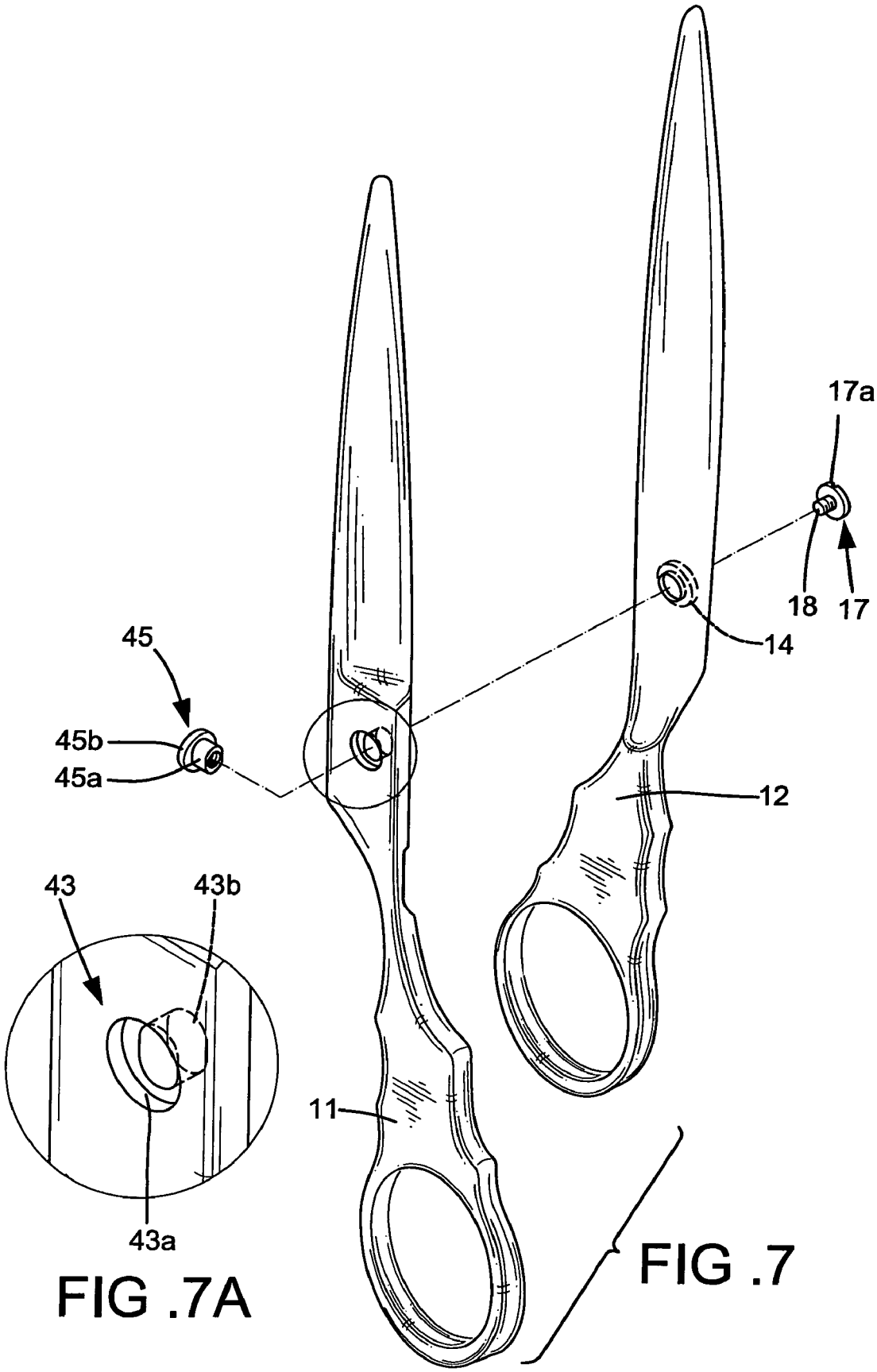
FIG. 7 is an exploded perspective view of another modified embodiment of the pair of scissors in accordance with the present invention.
FIG. 7A is an enlarged view of a circled portion in FIG. 7.

FIGS. 7 and 7A illustrate another modified embodiment of the invention, wherein the countersink (now designated by 43) of the first scissor element 11 has a larger section (now designated by 43*a*) facing away from the second scissor element 12 and a smaller section (now designated by 43*b*) facing the second scissor element 12. It is noted that the smaller section 43*b* is substantially ellipsoid. Further, the nut (now designated by 45) includes an enlarged head (now designated by 45*b*) and a substantially ellipsoid shank (now designated by 45*a*) in contact with a perimeter wall delimiting the smaller section 43*b* of the countersink 43. This arrangement also provides a reliable pivotal device.

Figures 8, 8A:
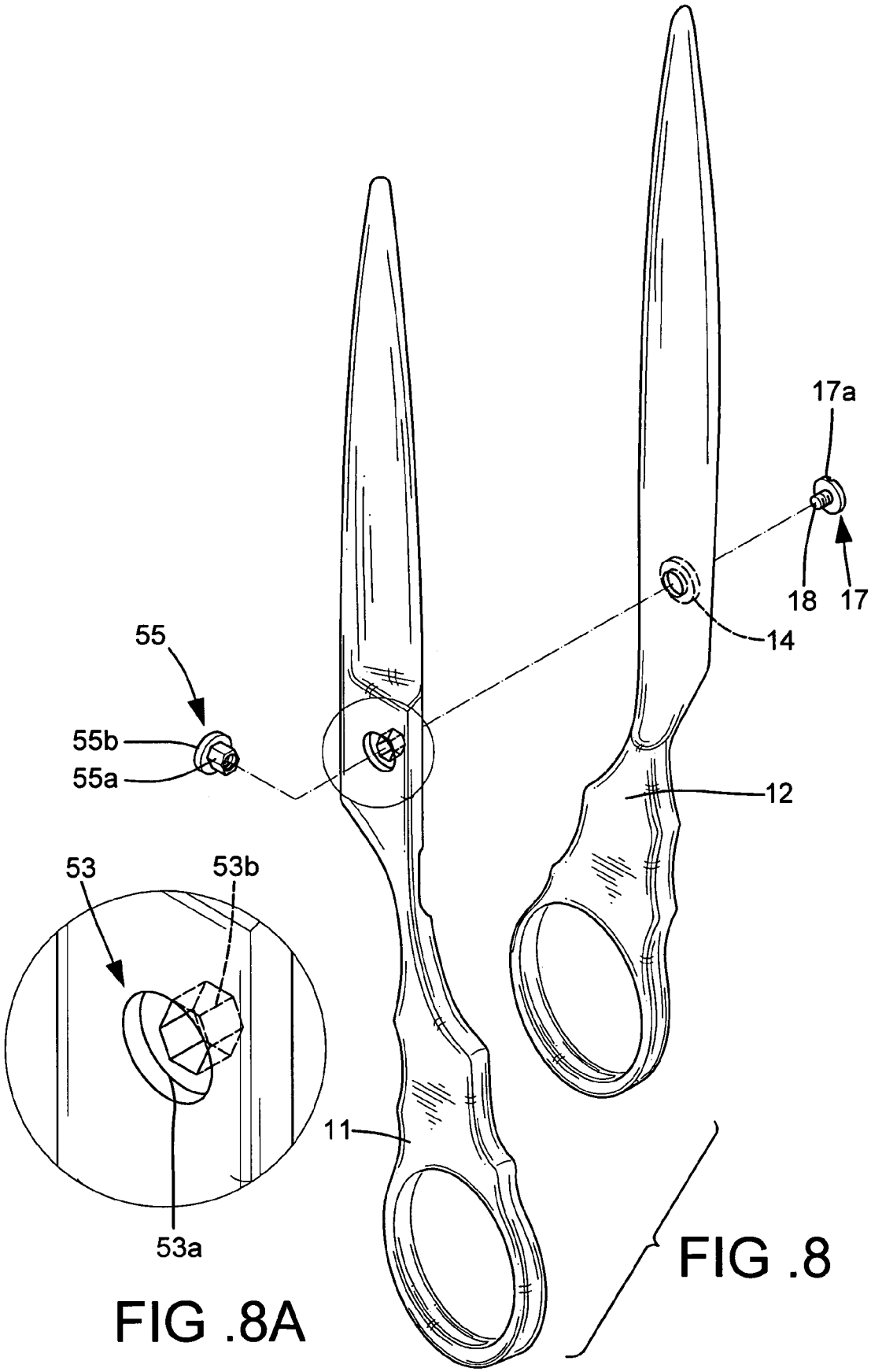
FIG. 8 is an exploded perspective view of a further modified embodiment of the pair of scissors in accordance with the present invention.
FIG. 8A is an enlarged view of a circled portion in FIG. 8.
Figure 9:
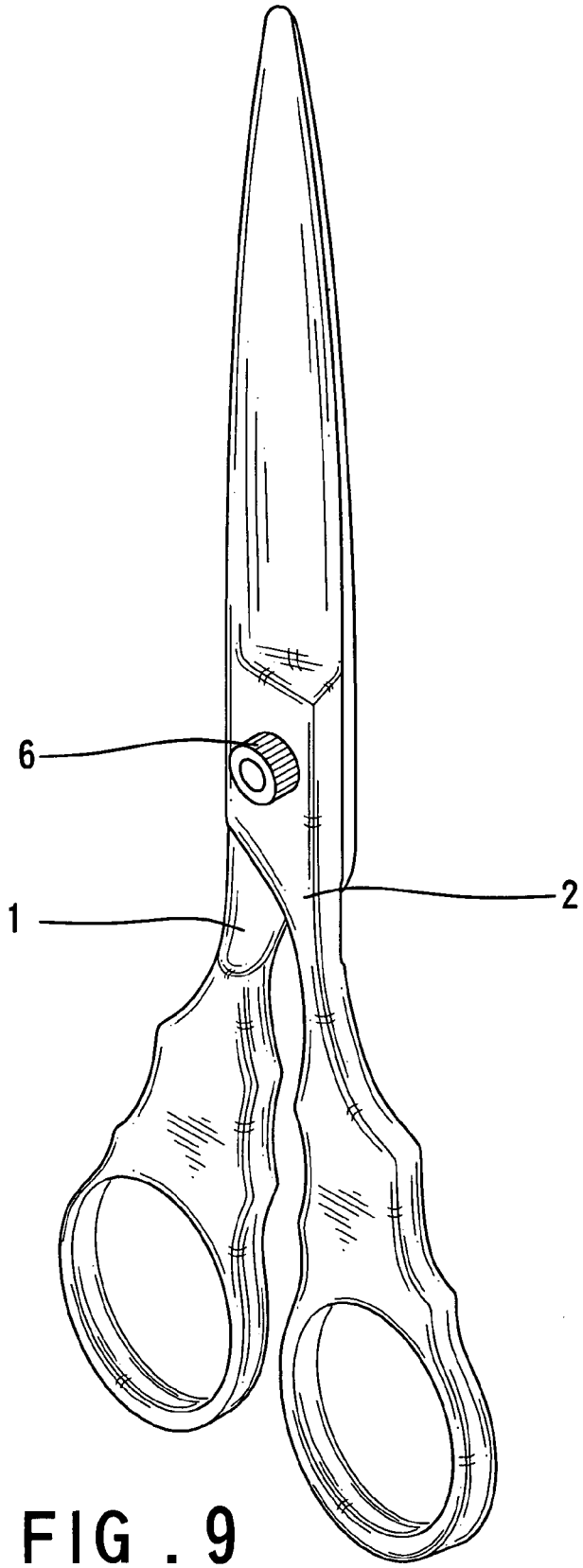
FIG. 9 PRIOR ART
FIG. 9 is a perspective view of a pair of conventional scissors.
Figure 10:
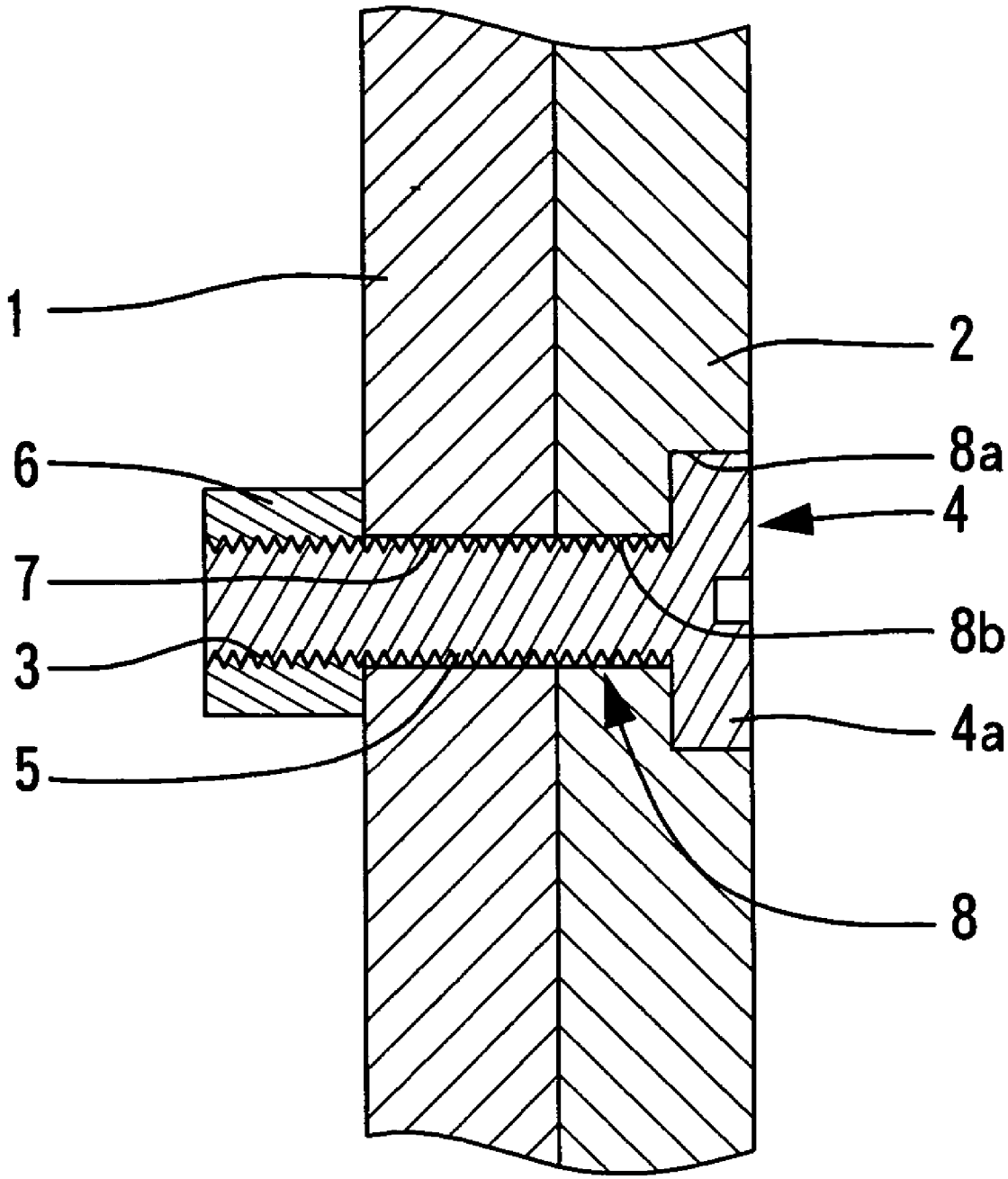
FIG. 10 PRIOR ART
FIG. 10 is a sectional view illustrating pivotal arrangement of the pair of conventional scissors.

FIGS. 8 and 8A illustrate a further modified embodiment of the invention, wherein the countersink (now designated by 53) of the first scissor element 11 has a larger section (now designated by 53*a*) facing away from the second scissor element 12 and a smaller section (now designated by 53*b*) facing the second scissor element 12. It is noted that the smaller section 53*b* is polygonal (e.g., hexagonal). Further, the nut (now designated by 55) includes an enlarged head (now designated by 55*b*) and a polygonal (e.g., hexagonal) shank (now designated by 55*a*) having, e.g., sides (not labeled) that are respectively in contact with, e.g., sidewalls delimiting the smaller section 53*b* of the countersink 53. This arrangement also provides a reliable pivotal device.

It is noted that other non-circular arrangements for the smaller section 23*b*, 33*b*, 43*b*, 53*b* of the countersink 23, 33, 43, 53 and corresponding non-circular arrangements for the shank 25*a*, 35*a*, 45*a*, 55*a* of the nut 25, 35, 45, 55 can be used.

Although the invention has been explained in relation to the preferred embodiments, it is to be understood that many other possible modifications and variations can be made without departing from the scope of the invention as hereinafter claimed.

What is claimed is:

1. A pair of scissors comprising:

a first scissor element;

a second scissor element; and a pivotal device for pivotally engaging the first scissor element with the second scissor element;

the first scissor element including a countersink extending from a first side of the first scissor element through a second side of the first scissor element, the countersink of the first scissor element having a larger section facing away from the second scissor element and a non-circular smaller section facing the second scissor element;

the second scissor element including a countersink extending from a first side of the second scissor element through a second side of the second scissor element, the countersink of the second scissor element having a larger section facing away from the first scissor element and a smaller section facing the first scissor element and aligned with the smaller section of the countersink of the first scissor element;

the pivotal device including a screw and a nut, the screw including a threaded shank and an enlarged head, the nut including a non-circular shank and an enlarged head, with a screw hole extending through the non-circular shank and the enlarged head of the nut;

the nut being received in the countersink of the first scissor element, with the enlarged head of the nut being received in the larger section of the countersink of the first scissor element, and with the non-circular shank extending through the non-circular smaller section of the countersink of the first scissor element and the smaller section of the countersink of the second scissor element; and the threaded shank of the screw being threadedly engaged with the screw hole of the nut, with the enlarged head of the screw being received in the larger section of the countersink of the second scissor element.

2. The pair of scissors as claimed in claim 1, wherein the non-circular smaller section of the countersink of the first scissor element is substantially circular and comprises two parallel flat portions delimited by two parallel flat walls, and wherein the non-circular shank of the nut is substantially circular and comprises two flat faces respectively in contact with the flat walls.

3. The pair of scissors as claimed in claim 1, wherein the non-circular smaller section of the countersink of the first scissor element is one of square, rectangular, polygonal, and ellipsoid, and wherein the non-circular shank of the nut is one of square, rectangular, polygonal, and ellipsoid and in contact with a perimeter wall delimiting the non-circular smaller section of the countersink of the first scissor element.

* * * * *